United States Patent [19]

Deslaugiers

[11] 4,034,526

[45] July 12, 1977

[54] STRUCTURE FOR PROVIDING AN ARCHITECTURAL SYSTEM AND METHOD FOR MAKING SUCH SYSTEM

[76] Inventor: François G. Deslaugiers, 93, rue Didot, 75014 Paris, France

[21] Appl. No.: 610,898

[22] Filed: Sept. 5, 1975

[30] Foreign Application Priority Data

Sept. 10, 1974 France ..... 74.30634

[51] Int. Cl.[2] ..... E04B 5/48; E04B 5/14

[52] U.S. Cl. ..... 52/220; 52/263; 52/404; 52/645; 52/648; 98/31; 52/745

[58] Field of Search ..... 403/190, 191; 52/758 R, 52/645, 648, 263, 220, 221, 404, 745; 98/31

[56] References Cited

U.S. PATENT DOCUMENTS

| | | | |
|---|---|---|---|
| 485,870 | 11/1892 | Larimer | 52/758 R |
| 692,309 | 2/1902 | Knoche | 52/758 R |
| 816,480 | 3/1906 | Lally | 52/758 R |
| 1,314,271 | 8/1919 | Kopp | 52/236 |
| 1,958,473 | 5/1934 | Dovell | 52/648 |
| 2,084,649 | 6/1937 | MacMillan | 52/648 |
| 2,616,529 | 11/1952 | Macdonald | 52/221 |
| 2,618,146 | 11/1952 | Ciarlini | 52/236 |
| 2,675,895 | 4/1954 | Loewenstein | 52/648 |
| 2,732,654 | 1/1956 | Sullivan | 52/758 R |
| 3,688,461 | 9/1972 | Rensch | 52/263 |

FOREIGN PATENT DOCUMENTS

| | | | |
|---|---|---|---|
| 405,581 | 8/1943 | Italy | 52/758 R |
| 1,079,751 | 8/1967 | United Kingdom | 52/236 |
| 727,954 | 4/1955 | United Kingdom | 52/648 |

*Primary Examiner*—James L. Ridgill, Jr.

[57] ABSTRACT

The invention relates to a modular structure and process for producing architectural systems.

A structure serving as a basis for the division of the volume occupied by an architectural system to be produced is defined by the assembly of vertical, horizontal, and auxiliary supporting members as well as horizontal supported members located in a reference grid. This assembly is brought about in strictly reversible manner by means ensuring the continuity of the internal and external resistant portions of the said members in accordance with the reference grid. The structure is completed by modular and interchangeable filling members such as floors, ceilings, panels, stopping plates etc.

A structure of this type permits a true modular construction, which can be modified in a simple, rapid and non-destructive manner.

When equipped with filling members this structure makes it possible to define and compartmentalize a continuous and easily accessible technical space or duct and a viable space, permitting the separation of each continuous wall belonging to one functional part of the architectural system from the other walls of the system by an insulating space.

13 Claims, 19 Drawing Figures

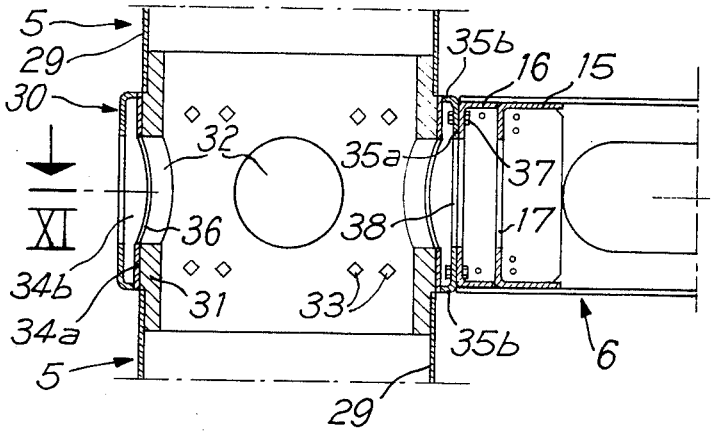
FIG. 10
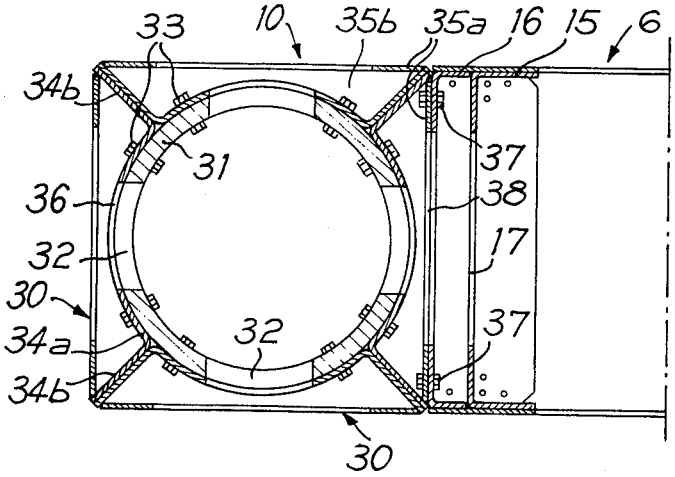
FIG. 11
FIG. 12
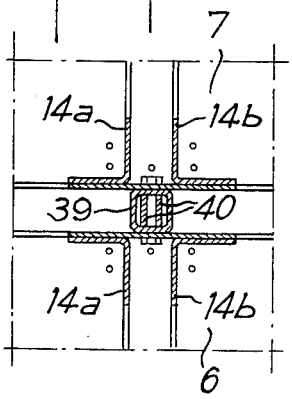
FIG. 13
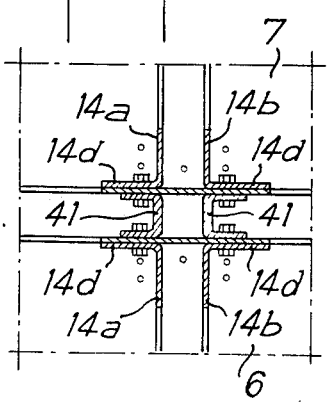
FIG. 14
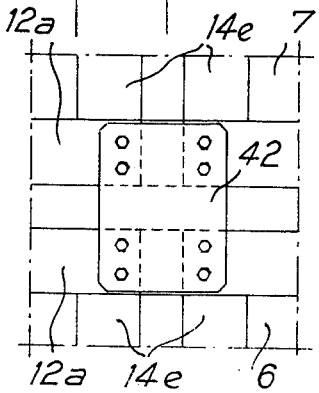

STRUCTURE FOR PROVIDING AN ARCHITECTURAL SYSTEM AND METHOD FOR MAKING SUCH SYSTEM

BACKGROUND OF THE INVENTION

The present invention has for its object a process and a modular structure for producing architectural systems.

Numerous modular construction processes are known i.e. making it possible to obtain a stable structure serving as a basis for the division of the volume occupied by an architectural system by means of the assembly of supporting and supported members.

According to one of these known processes a concrete structure is produced, with or without reinforcements and generally comprising posts and floors. The assembly of these members is complex and irreversible. Moreover, these members are generally solid so that it is then necessary to make the technical space (duct), i.e. the space used for the circulation of current and fluids, such as water, air and electricity.

According to another known process a structure is produced by means of metal sections, selected from a plurality of different heterogeneous and graded members. However, in general such a structure is not sufficient to ensure the stability of the architectural system and it is necessary to supplement the structure with filling members such as floors and concrete partitions. The technical space defined hereinbefore can be made by multiplying the number of the said filling members but such an operation would be difficult or impossible to generalise for the whole structure in order to obtain a continuous technical space, and in addition the result obtained would be irreversible.

According to a third known process, three-dimensional structures in the form of wire lattices are produced which form rigid horizontal sheets, generally located on vertically arranged metal sections and whose inadequate stability necessitates the use of vertical wind bracing. Moreover, these structures are difficult to partition and the technical space which they are liable to define, is obstructed and can only protect circulation systems of limited cross-section.

Finally the rigidity of these structures is due to their homogeneity and compactness, which limits the variety of shapes which they can assume.

BRIEF SUMMARY OF THE INVENTION

The problem of the present invention is to obviate the disadvantages indicated hereinbefore and to provide a process for producing architectural systems comprising vertical and horizontal supporting members and supported members, whose assembly constitutes a modular structure serving as a basis for the division of the volume occupied by the said system, whereby the said structure is auto-stable, rigid, modifiable without involving destruction and defining by its internal volume a continuous space which can be partitioned at random and has numerous access points, the said space being usable as the technical space.

This problem is solved by a process in which, as in most known modular construction processes, a square meshed references grid is defined in a horizontal plane corresponding to at least one level of the system to be constructed and whereby, according to the invention:

a reference grid formed by two orthogonally directed sheets, each produced by rectilinear strips of width $i$ distributed uniformly with a pitch $p$ is defined, so that the said grid is thus formed from squares with sides $p - i$, separated from the adjacent squares by a gap of width $i$;

hollow and cylindrical vertical supporting members or posts are disposed, each in such a manner that its vertical axis passes through the centre of a square of the reference grid;

horizontal supporting and supported members of the same height are used produced in the form of hollow bodies having partitions with openings and whose external horizontal dimensions can be expressed in the form $mp + i$, $kp$ or $np - i$, $m$, $k$ and $n$ being positive integers, and $m$ can be zero, in such a way that the members have all their constituent parts in the reference grid;

the said supporting and supported members are arranged in such a way that the internal volumes of the said members form, once assembled, a continuous space having access points and usable as a technical space or duct for conveying all types of fluids and/or current;

the said members are assembled in strictly reversible manner by means ensuring the continuity of the inner and outer resistant portions of the said members according to the two directions of the reference grid.

The definition of the reference grid and the use of members whose constituent parts are located within the said grid, combined with an assembly carried out in strictly reversible manner, permits a true modular construction, i.e. permitting an extension, reduction or restructuring of the structure in a simple, rapid, non-destructive manner and limited to that part of the structure to be modified. Moreover, all components removed from the structure have undergone no modification and can therefore be reused in the same structure or in another structure.

Moreover, by assembling the members by means ensuring the continuity of the resistant portions of the said members in accordance with the two directions of the reference grid, the structure is given an equivalent rigidity in accordance with these two directions, i.e. a mechanical isotropy which, for a given structure, is independent of the combination of members selected for constituting the structure and the gaps in the latter.

Finally, by arranging the members in such a way that their internal volumes communicate by the said openings, a continuous space is obtained having numerous access points, which can be partitioned at random and usable as the technical space.

According to another feature of the process according to the invention the assembly of the members is brought about by bolting, leading to the desired reversibility.

The object of the invention is also achieved by a modular structure for producing an architectural system, whereby the said structure serves as a basis for the division of the volume occupied by the said system, whilst being obtained by assembling vertical and horizontal supporting members and supported members in accordance with a square meshed reference grid in each horizontal plane corresponding to a level of the structure, the said structure comprising according to the invention:

hollow cylindrical posts or vertical supporting members, each arranged in such a way that its vertical axis passes through the centre of one square of the reference grid;

horizontal supporting and supported members of the same height whose constituent parts are located in the reference grid, whereby the latter is formed by two orthogonally directed sheets, each produced by rectilinear strips of width $i$, uniformly distributed with a pitch $p$, the said horizontal supporting and supported members being in the form of hollow bodies having partitions with openings and whose external horizontal dimensions can be expressed in the form $mp + i$, $kp$ or $np - i$, $m$, $k$ and $n$ being positive integers;

connecting members connecting in strictly reversible manner supporting members which are horizontal relative to the vertical supporting members;

connecting devices connecting once again in strictly reversible manner the horizontal supporting and supported members and ensuring the continuity of the internal and external resistant portions, the said supporting and supported members being assembled in such a way that their assembled internal volumes form a continuous space having access points and usable as the technical space for the passage of all types of fluids and/or current.

According to another feature of the structure according to the invention the horizontal supporting and supported members are parallelepipedal members comprising a longitudinal rigid body and double transverse partitions leaving between them a gap of width $i$ and longitudinally distributed according to a multiple of pitch $p$, whereby the said multiple is preferably common to the whole structure and equal to the width of the supported members, plus the gap $i$, whereby the connecting means between the supporting and supported members and between the supported members themselves are positioned adjacent to one end of the said partitions.

This special arrangement of the connecting means gives the structure an equivalent rigidity in the two directions of the reference grid, permitting the continuity thereof between partitions of adjacent members whose longitudinal bodies are positioned parallel to one another and between the lateral faces of one member and the partitions belonging to a perpendicular member. This continuity can be interrupted at any assembly point by a simple support connection.

Finally, according to another feature of the structure according to the invention this structure has auxiliary horizontal supporting members of reduced width. This is advantageous for the reinforcement of the structure at places where it has large gaps or, for example, for lighting the weight of the edges of the structure.

BRIEF DESCRIPTION OF THE DRAWING

Other and further objects of the present invention will be apparent from the following description and claims and are illustrated in the accompanying drawings which by way of illustration show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the scope of the appended claims. In the drawings show:

FIG. 10 a schematic elevational and sectional view of a device for interconnecting vertical and horizontal supporting members;

FIG. 11 a sectional view along the line XI—XI of FIG. 10;

FIGS. 12, 13 and 14 respectively schematic plan and sectional view of FIGS. 12 and 13 of embodiments of a device for interconnecting horizontal supporting or supported members or adjacent supported members whose longitudinal bodies are positioned parallel to one another;

DETAILED DESCRIPTION OF THE PREFERRED EMBODIMENTS

Figure 1:
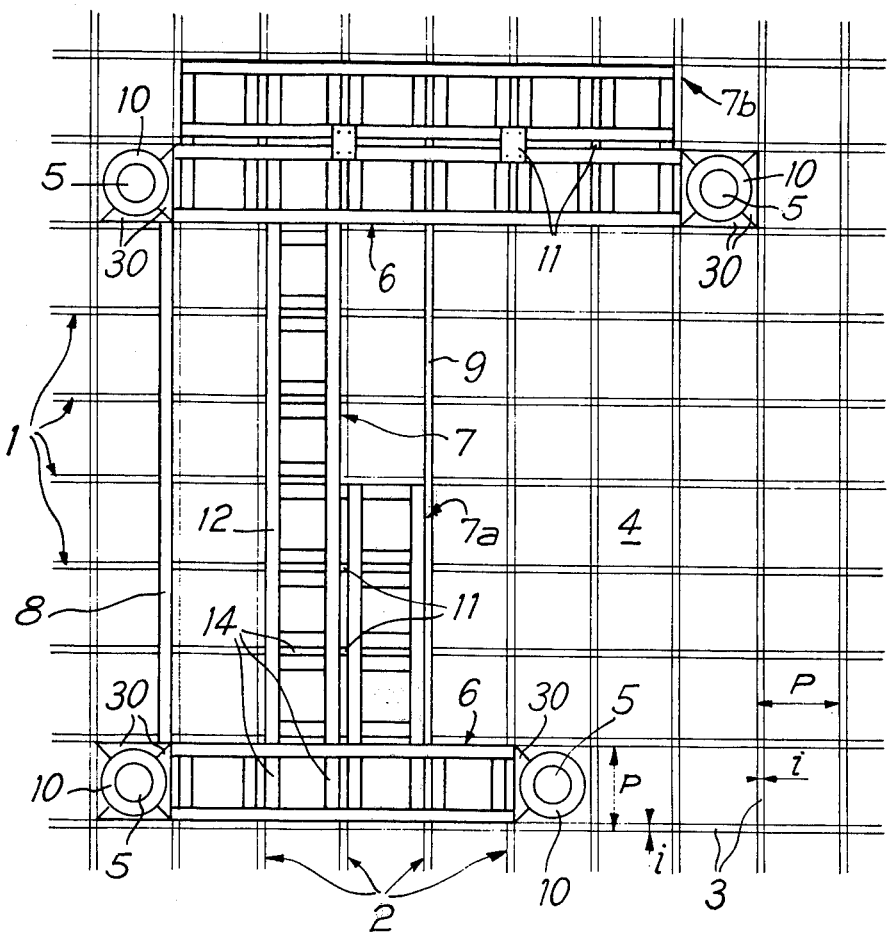
FIG. 1 is a schematic plan view of the reference grid and a structure assembled according to the invention.

FIG. 1 illustrates the installation of a reference grid of a structure or part of a structure according to the invention. The reference grid is defined in a horizontal plane and preferably common to all the horizontal levels of the architectural system to be produced. This reference grid is formed by two sheets 1 and 2 whose directions are perpendicular to one another, each of the sheets being produced by rectilinear strips 3 of width $i$ uniformly distributed with a pitch $p$. The reference grid is thus formed by squares 4 with sides $- i$ separated from adjacent squares by a gap $i$.

The structure shown in FIG. 1 has vertical supporting members 5 of cylindrical shape, whose axis is centred relative to a square 4 of the reference grid and to which are connected the horizontal supporting members 6. A horizontal supporting member extends over a length equal to that separting two squares 4 of the reference grid relative to which are centred the two vertical supporting members 5. The said length can therefore be express in the form $mp + i$, $m$ being a positive integer. Horizontal supported members 7, 7a and 7b are connected to the horizontal supporting members 6. In the embodiment shown in FIG. 1 the horizontal supporting and supported members 6 and 7 have a constant width equal to $p - i$ and are therefore located longitudinally between two strips 3 of the reference grid. The supported members such as 7 are fixed by their two ends and have a length expressed in the form $mp + i$, the supported members such as 7*a* have a free end and a length expressed in the form $kp$ and the supported members such as 7*b* have two free ends and a length expressed in the form $np - i$. The structure can also have auxiliary supporting members of reduced width 8 or of the trimmer type 9. The latter, of width $i$, is located in accordance with a strip 3 of the reference grid.

The vertical and horizontal supporting members are interconnected by connecting devices 10 and the adjacent and parallel supported members on the one hand and the supporting and supported members on the other hand, are interconnected by connecting means 11.

The various members and devices forming part of the structure illustrated in FIG. 1 will now be described in greater detail.

Figure 2:
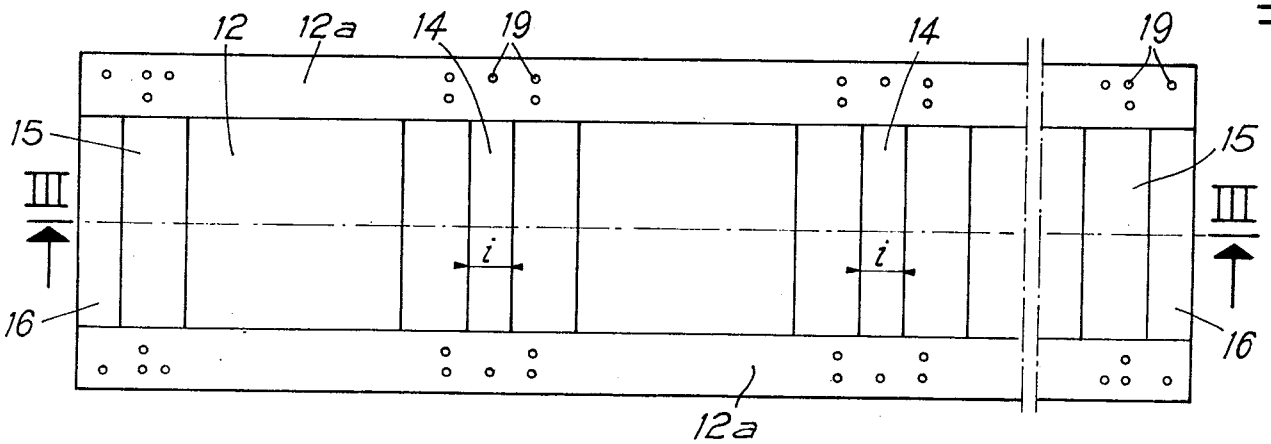
FIG. 2 a schematic plan view of a horizontal supporting or supported member.
Figure 3:
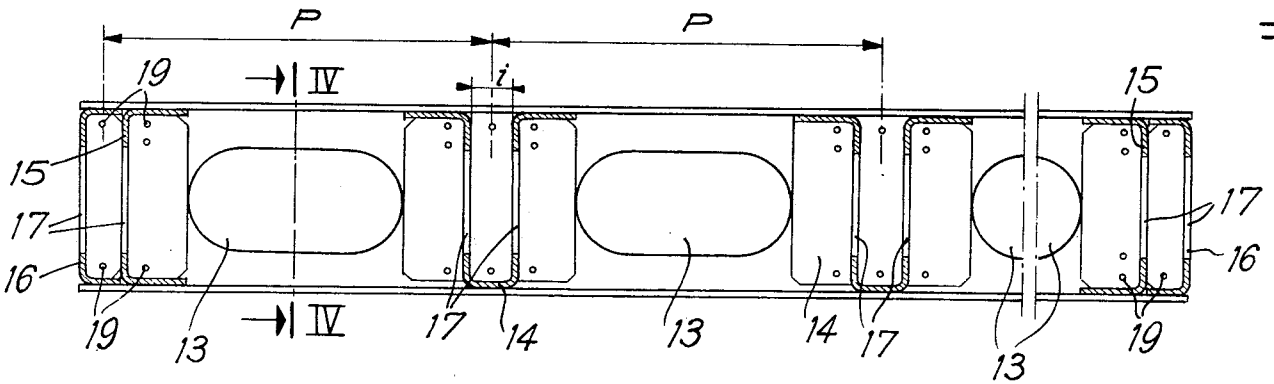
FIG. 3 a sectional view along the line III—III of FIG. 2.
Figure 4:
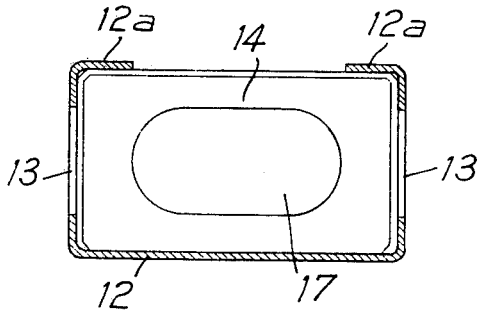
FIG. 4 a sectional view along the line IV—IV of FIG. 3.
Figure 5:
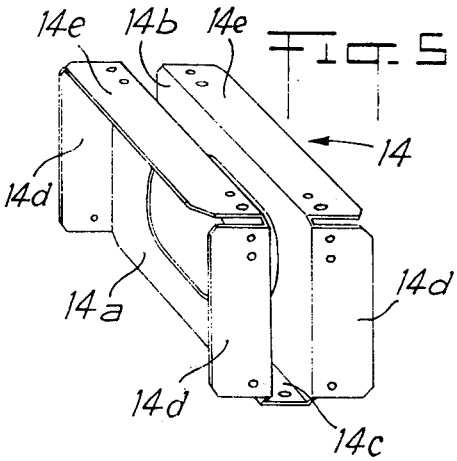
FIG. 5 a schematic perspective view of a double partition arranged within a member such as shown in FIGS. 2 to 4.

FIGS. 2, 3 and 4 illustrate a horizontal supported member 7 or a supporting member 6. Such a member essentially comprises a longitudinal body 12 having a U-shaped cross-section with a flat base having upper edges 12*a* folded internally parallel to the said base. The lateral faces of the horizontal body 12 have oblong shaped openings 13 which are regularly distributed along the said lateral faces with a pitch $p$. The longitudinal body 12 is internally provided with double partitions 14 and end partitions 15, 16. These partitions have on their walls perpendicular to the longitudinal axis of body 12, oblong shaped openings 17 which are preferably identical to openings 13. Openings 17 are such that they are aligned after the fitting of the partitions in body 12. The double partitions 14 are positioned transversely to body 12 and are longitudinally distributed in regular manner with pitch $p$. As can be seen in FIGS. 3 and 5 the double partitions 14 have two parallel walls 14*a* and 14*b*, separated by a gap equal to $i$, having openings 17 and positioned transversely within body 12. The lower edges of the walls 14*a* and 14*b* are joined by a rectangular plate 14*c*, whose width is equal to $i$ adjacent to the base of body 12. The vertical edges of the said walls have rectangular folds 14*d* perpendicular to the walls and directed externally relative to the gap separating the walls. Each upper edge of the walls 14*a* and 14*b* also has a rectangular fold 14*e*, directed externally relative to the gap separating the walls. The end partitions 15 and 16 have the general shape of a rectangular box, i.e. with a wall positioned transversely in body 12 and having an opening 17, whereby the four edges of the said wall have folds perpendicular to the wall and positioned towards the inside of body 12. The folds of partitions 16 which enter furthest into body 12 have a width equal to $i$. The folds of partitions 15 and the double partitions have a width preferably equal to that of the edges 12*a* of body 12. The openings 13 are made on the lateral faces of body 12 between two partition emplacements.

The supported members 7*a* and 7*b* only have the end partition 15 at their free ends.

Figure 6:
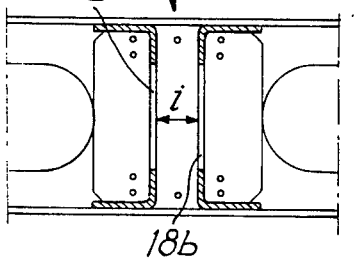
FIG. 6 a schematic elevational and sectional view of an embodiment of a double partition.

FIG. 6 shows an embodiment of a partition 18 having two walls 18*a* and 18*b*. This partition is formed by two partitions identical to end partitions 15, arranged back to back and separated by gap $i$.

The longitudinal body 12 and the partitions with which it is equipped are made from cut and folded thin sheet metal. The partitions are fixed within body 12, for example, by spot welding. The sheet thickness is determined as a function of the intended task of the supporting or supported member and of the permitted overload. The horizontal supported and supporting members have the same height, determined in such a way as to ensure an adequate mechanical strength as a function of the maximum length of the said members and of the permitted overload.

Each horizontal supported and supporting member has identical bores 19 distributed uniformly and symmetrically on its lateral faces, its base and its upper edges, so as to permit its assembly by bolting to the other members of the structure. These bores are made at a level where the member has a double partition or an end partition. The end partitions 16 also have bores on their wall so as to permit the end fitting of the member.

On referring to FIG. 1 it can be seen that due to the configuration of the horizontal supported and supporting members, after arranging them in accordance with the reference grid and assembling the same a continuity of the internal and external resistant portions of the said members if obtained in accordance with the two directions of the reference grid. The folds of the double partitions 14 and the upper edges 12*a* of longitudinal bodies 12 have the same length, so that this continuity is obvious due to the fact that after assembling a supporting member 6 and a perpendicular supported member 7 or 7*a* the two double partitions 14 of the supporting member 6 level with which the assembly is carried out, extend the longitudinal body 12 of member 6. The continuity is also obvious between partitions of supporting and supported members on the one hand and supported members on the other assembled in parallel. Due to this continuity, by having the means for bringing about connections between the supporting and supported members on the one hand or the supported members themselves on the other adjacent to the ends of the partitions thereof a true mechanical isotropy of the assembled structure is obtained.

Figure 7:
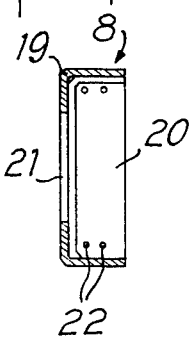
FIG. 7 a schematic cross-section of a auxiliary horizontal supporting member.

FIG. 7 shows an elevational and sectional view of an auxiliary supporting member 8 having the same height as the horizontal supporting member 6 but having a reduced width. The auxiliary supporting member 8 comprises a longitudinal body 19, having a U-shaped cross-section equipped with transverse partitions 20 and having on its lateral face corresponding to the base of the U, openings 21 which are regularly distributed with a pitch $p$ and are identical to the openings 13 and 17. The auxiliary supporting member 8 is similar to the lateral portion of a horizontal supporting member limited to the vertical plane passing through the side of an edge 12*a* of body 12. Member 8 has bores positioned identically to those of the lateral portion of the horizontal supporting member defined hereinbefore. The double partitions 20 and the end partitions have bores 22. These bores are intended to permit, in the case of the double partitions, the assembly of two auxliary supporting members such as 8 by means of transverse members or angle irons bolted to the partitions and in the case of the end partitions the connection to a vertical supporting member 5 by means of a connecting member 10. An auxiliary supporting member such as 8 is positioned between two vertical supporting members, e.g. to form a tie or to support a single row of horizontal supported members.

Figure 9:
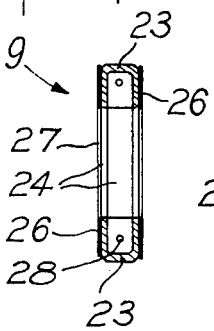
FIG. 9 a sectional view along the line IX—IX of FIG. 8.
Figure 8:
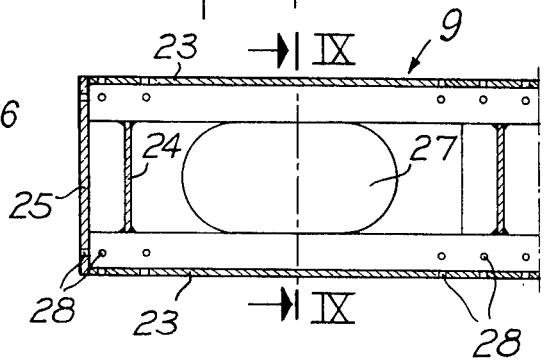
FIG. 8 a schematic elevational and cross-sectional view of an auxiliary horizontal supporting member of the trimmer beam type.

FIGS. 8 and 9 illustrate a second type of auxiliary supporting member of the trimmer type 9, whose width is equal to *i*. It comprises a longitudinal body formed by two longitudinal beams 23 having a U-shaped cross-section and joined by vertical crossbeams 24, end plates 25 made from thick metal sheets and lateral members 26 made from thin metal sheets. The U basis of the longitudinal beams 23 constitute the upper and lower faces of the trimmer 9 and the members 26 its lateral faces. The crossbeams 24 have a U-shaped configuration whose base is positioned vertically and transversely in trimmer 9, whereby they are distributed in regular longitudinal manner with a pitch *p*. The lateral members 26 have openings 27 identical to openings 13 and 17 and distributed longitudinally with a pitch *p*. The bores 28 are made in the wings of the U and in the upper and lower faces of the trimmer to permit the assembly of other members, as well as in the end plates 25 for fixing the trimmer.

FIGS. 10 and 11 illustrate a connecting device 10 between a vertical supporting member or post 5 and a horizontal supporting member 6. The vertical supporting member 5 substantially comprises hollow cylindrical bodies 29 having a preferably circular cross-section and whose height is equal to the gap separating two consecutive horizontal levels of the architectural system to be produced. The bodies 29 are made from longitudinally welded and rolled metal sheeting or of rolled steel. The connecting device 10 substantially comprises one to four brackets 30 and a hollow core 31. The hollow core 31 is a thick-walled cylindrical body having a circular cross-section and whose external diameter is equal to that of the cylindrical bodies 29 with which it is assembled by deep joints able to transmit forces of all types. The core 31 has four circular openings 32 and radial bores permitting the fixing of brackets 30 by bolts 33. There are one to four brackets 30 depending on the number of horizontal supporting members to be connected to the same post 5. A bracket 30 having the same height as the horizontal supporting member 6, which it connects, and comprises two cut and shaped metal sheeting members assembled by continuous welding, e.g. arc welding over their entire periphery. The first of these members 34 preferably has a vertical portion 34*a* in the form of a quarter ferrule and applied against the outer surface of core 31 and two rectangular and vertical radial portions 34*b*. The second member 35 has a vertical rectangular portion 35*a* which is applied against the end of a horizontal supporting member and two upper and lower horizontal flanges 35*b*. Member 34 has in its portion 34*a* an opening 36 corresponding to an opening 32 made in core 31 and bores to permit its bolting to core 31 by means of bolts 33. Member 35 has in its portion 35*a* bores permitting its fixing by means of bolts 37 to the end partition 16 of a horizontal supporting member 6 and an opening 38 of identical shape and corresponding to openings 17 made in the partitions of the horizontal supporting member.

The connecting member 10 ensures the transmission of forces and the rigidity of the structure, permitting by openings 38 and 36 as well as bores 32, the interconnection of the inner volume of a vertical supporting member with that of the horizontal supporting member or members connected thereto. Bearing in mind that the horizontal supported and supporting members have identical openings which are interlinked due to their emplacements and the location of the said horizontal members in the reference grid, the internal volumes of the vertical and horizontal members form a continuous space having numerous access points and usable for protecting the circulation of all types of fluids and current.

FIGS. 12, 13 and 14 show three embodiments of a device for interconnecting horizontal supported members and supporting members on the one hand or supported members on the other, whose longitudinal bodies are parallel, for example, between a horizontal supporting member 6 and a horizontal supported member 7.

FIG. 12 shows a sectional plane view of a first embodiment of a connecting device comprising a square tube 39 reinforced by transverse linings 40. Tube 39, which forms a shim *i* between the supporting and supported members 6 and 7 separated by a gap *i*, is bolted to the adjacent vertical faces of the supporting and supported members 6 and 7 level with the gap *i* separating the transverse walls 14*a* and 14*b* of two double-walled partitions 14 of the supporting and supported members 6 and 7. A shim of reduced length makes it possible to bring about a connection by supporting alone and a shim of identical length to the height of the said members, brings about a fitting connection and permits the continuity of the double partition 14.

A second embodiment of a connecting device illustrated by FIG. 13 comprises two U-shaped sections 41, whose length is equal to the height of the supporting and supported members 6 and 7, whereby the bases of sections 41 extend the said walls 14*a* and 14*b* into the gap between members 6 and 7. Sections 41 are bolted by their wings to the adjacent vertical faces of the supporting and supported members 6 and 7, reinforced by the folds 14*d* of partition 14.

FIG. 14 illustrates a third embodiment of a connecting device comprising two identical plates 42, respectively bolted to the upper edges 12*a* and the lower faces of the two supporting and supported members 6 and 7, adjacent to the emplacement level of the double-walled partitions 14 in the said members. Upper plate 42 is bolted to the upper edges 12*a*, reinforced by the folds 14*a* of a partition 14.

This third embodiment of a connecting device is preferably used for bringing about a fitting connection ensuring the complete mechanical continuity of the connected members for all types of stress. It is then preferably associated with one of the two first embodiments or the connecting means described hereinafter with reference to FIGS. 15 and 16.

Figure 16:
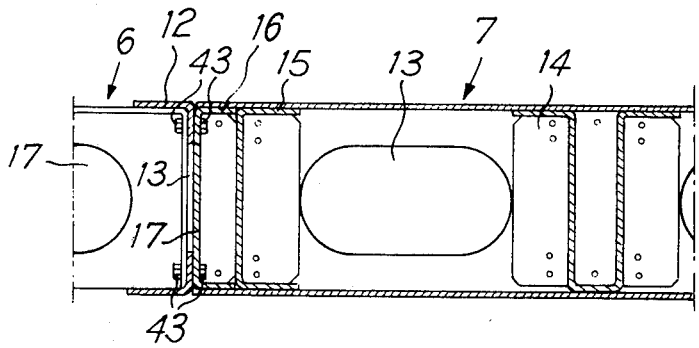
FIG. 16 sectional view along the line XVI—XVI of FIG. 15.
Figure 15:
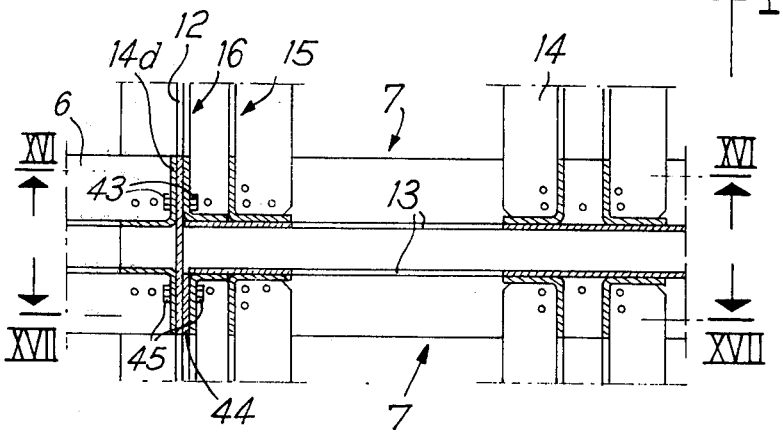
FIG. 15 a schematic plan view of two embodiments of a connection between a supporting member and a horizontal supported member whose longitudinal bodies are positioned perpendicular to one another.
Figure 17:
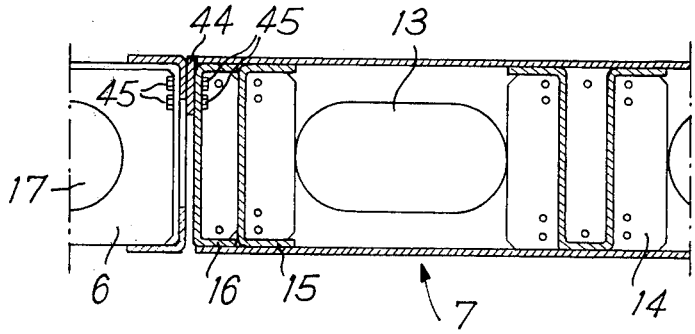
FIG. 17 a sectional view along the line XVII—XVII of FIG. 15.

FIGS. 15, 16 and 17 illustrate two connecting means for interconnecting on the one hand two horizontal supported and supporting members or on the other two supported members, whose longitudinal bodies are perpendicular to one another, for example, between a horizontal supporting member 6 and a supported member 7.

The first embodiment illustrated in the upper part of FIG. 15 and FIG. 16 is a connecting member of the recessing type. The end partition 16 of the supported member 7 is applied to the lateral face of longitudinal body 12 of supporting member 6 in such a way that the opening 17 of the said end partition 16 coincides with an opening 13 in the said lateral face. Partition 16 of the supporting member 6 is bolted by bolts 43 to the lateral face of body 12 of the supported member 7 reinforced by folds 14*d* of the double-walled partition 14 present in supported member 7 level with the joint.

The second embodiment shown in the lower part of FIG. 15 and FIG. 17 is a connecting means based on support alone. It differs from the first embodiment by the presence of a rectangular shim 44 of reduced height carried by the upper part of end partition 16 of supported member 7 and by a single bolt system utilising bolts 45 level with the emplacement of shim 44. Bolting ensures a certain flexibility of the joint. The connection of the auxiliary horizontal supporting members of reduced width to the vertical supporting members, is brought about by means of the connecting device 10 described hereinbefore. The connection of the auxiliary supporting members of the trimmer type to an orthogonal or adjacent supported or supporting member is simply brought about by frontal or lateral bolting.

The structures shown schematically in FIG. 1 and whose constituent parts and their assembly methods have been described hereinbefore, is particularly well suited to the production of architectural systems of light-weight construction such as appartment blocks.

Figure 18:
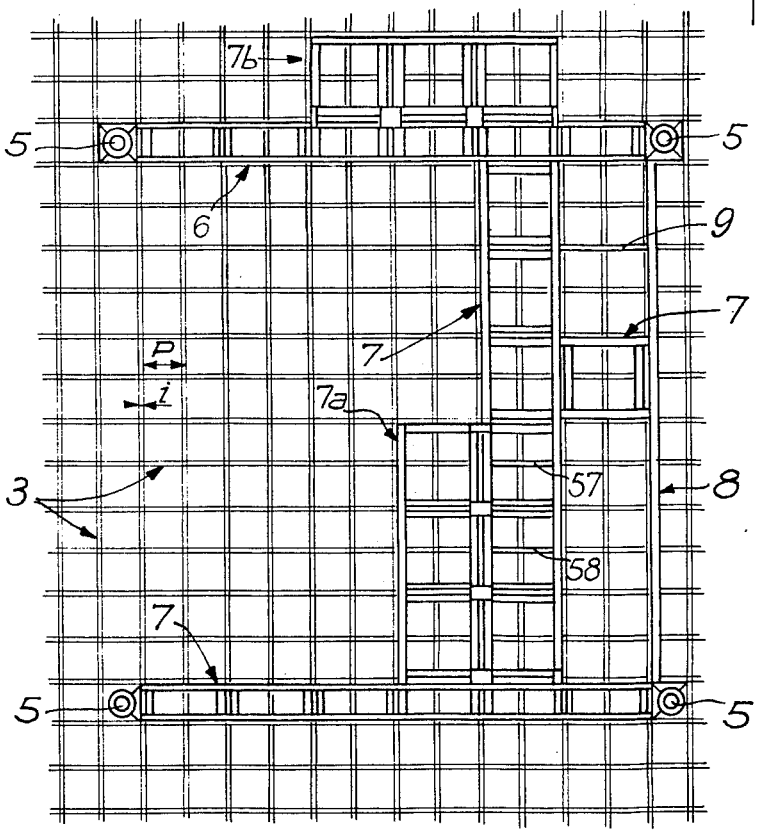
FIG. 18 a schematic view of the reference grid and a variant of a structure according to the invention.

FIG. 18 schematically shows a structure located in a reference grid identical to that of FIG. 1 and adapted to larger bearing surfaces and loads, such as those desirable in administrative or industrial buildings. The metal sheets used for the various vertical supporting members 5, horizontal supporting members 6, supported members 7, 7*a* and 7*b*, reduced width auxiliary supporting members 8 or members of the trimmer type 9 are thicker. The horizontal supported members 7 have a width expressed in the form $np - i$, $n$ being a positive integer equal to 2 in the example illustrated by FIG. 18. The partitions of the horizontal supported and supporting members are then regularly longitudinally distributed with a pitch which is a multiple of the pitch $p$, preferably equal to $np$.

Figure 19:
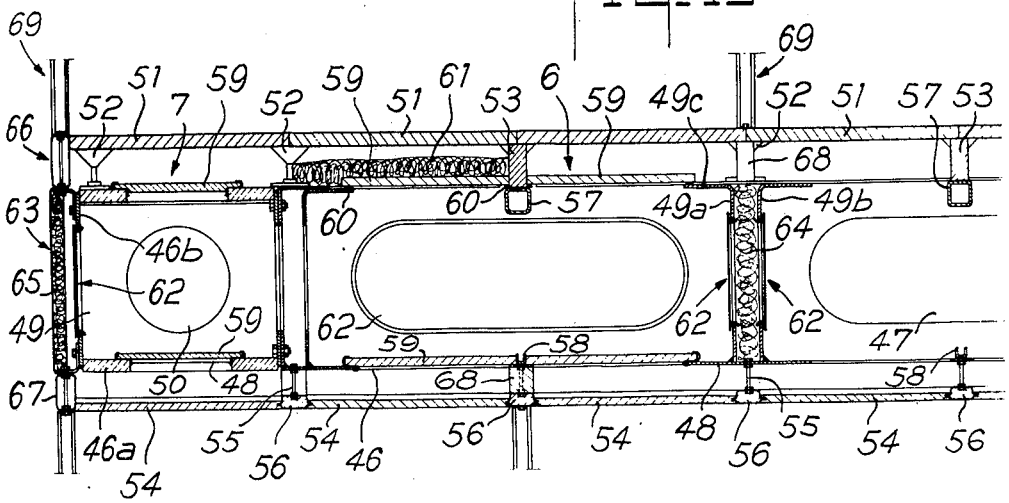
FIG. 19 a schematic elevational and sectional view of a structure according to the invention such as illustrated in FIG. 18 equipped with filling members.

FIG. 19 is a sectional and elevational view, more particularly illustrating a horizontal supporting member 6 and a supported member 7 connected perpendicularly to the member 6 in a structure such as that illustrated in FIG. 18.

The horizontal supported and supporting members essentially comprise a longitudinal body formed, for example, by two U-shaped main beams 46 whose bases constitute the lateral faces of the members, and which are connected by transverse partitions. The main beams 46 can be formed from a single piece of folded sheet metal or by welding two thick footings 46*a*, constituting the wings of the U and a thinner web 46*b* forming the base of the U. The vertical lateral faces of the supporting and supported members 6 and 7 have circular or oblong openings 47. The transverse partitions are double-walled separated by a gap $i$ and constituted, for example, by a lower horizontal footing 48 positioned between the two main beams 46 and the two inverted L-shaped flanges 49. The stems of the L's constitute the two vertical walls 49*a* and 49*b* of the double-walled partitions and the bases 49*c* of the L's are welded to the upper parts of the main beams 46. The vertical walls 49*a* and 49*b* each have an opening 50, for example, of circular configuration.

The connecting devices and connecting means for the members of the structure shown in FIG. 18, are similar to those described for the structure illustrated in FIG. 1, and ensure the same mechanical isotropy of the structure.

A structure such as illustrated in FIG. 1 or 18 serves as a basis for the division of the volume occupied by the architectural system to be produced. It defines in itself the separation into technical space and habitable or viable space. This structure is to be supplemented by interchangeable filling members for enclosing and compartmentalising the technical space and the viable space. These filling members can be subdivided into horizontal and vertical filling members. The main horizontal filling members are floor members, ceiling members and sealing members, whereby the latter mainly serve to seal the upper and lower openings in the horizontal supported and supporting members. The main vertical filling members are outer and inner wall members or panels and the stopping and facing members, the latter mainly serving to seal the vertical openings of the horizontal supported and supporting members.

FIG. 19 illustrates several of these filling members. The supporting and supported members 6 and 7 support a floor formed from slabs 51 by means of jacks 52 and/or blocks 53 and a suspended ceiling comprising members 54 by means of threaded rods 55 and rails 56. The floor members 51 and the ceiling members 54 are made from a fire-resistant material and are preferably modular members whose dimensions are adapted to the reference grid in which the structure is located, e.g. the floor slabs are squares with sides $p$. The jacks 52 and rods 55 are preferably positioned at the grid joints, i.e. level with the squares of side $i$ defined by the intersections of the rectilinear strips 3. As in the embodiment illustrated in FIG. 16 the supported member 7 has partitions spaced by $2p$, making it necessary for the purpose of supporting jacks 52 or blocks 53 and suspending rods 55 to respectively provide trimmers 57 and joists 58 (FIGS. 18 and 19) which are horizontal and fixed to the wings of main beams 46, transversely relative to the said main beams halfway between two adjacent partitions.

The supporting and supported members 6 and 7 also support horizontal filling members in the form of sealing members, such as rectangular plates 59 made from an insulating material sealing the upper openings and optionally the lower openings of the supporting and supported members 6 and 7. The sealing plates 59 are placed on the edges and upper and optionally lower folds of the longitudinal bodies and the partitions of the horizontal supporting and supported members with the optional interpositioning of a joint 60. The horizontal sealing plates permit the closure at random of the technical space and the separation thereof from the viable space by two intermediate spaces defined by the said plates, and the floor or ceiling members. These intermediate spaces can contain an insulating layer such as 61 and optionally a sealing layer on the said insulating layer. The interpositioning of an insulating layer and a sealing layer makes it possible in the case of damp areas or rooms to use floor members which are identical to those used elsewhere.

FIG. 16 also shows the vertical filling members, such as stopping members 62, facing members 63 and braces 66 and 67.

The stopping members 62 are shaped like plastic or metal covers and serve to compartmentalise the technical space by blocking the openings made in the walls of the partitions or on the vertical faces of the supporting or supported members. An insulating packing 64 can be placed between two adjacent stopping members. The facing members 63 are metal boxes used as a facade for a structural member and lined with insulating material 65. The upper braces 66 and lower braces 67 serve to seal into a facade the intermediate underfloor and above-ceiling spaces. These spaces can also be compartmentalised by draught-proofing barriers such as 68 with a view to using them as communication spaces, secondary technical spaces and insulating spaces. Each functional portion of the technical space, e.g. a blowing sheath can be surrounded by its own continuous wall separated from the other walls of the system by an insulating space, optionally lined with insulating material. This makes it unnecessary to place insulating material within the actual technical space, because the latter can prove troublesome especially when the technical space is used for the circulation of conditioned air.

The other vertical filling members are internal and external walls which serve to compartmentalise the viable space. Preferably interchangeable modular panels compatible with the reference grid in which the structure is located, supported by posts installed at the joints of the said grid are used. The posts are preferably such that they can receive four pairs of independent panels constituting double-walled partitions 69, having good heat and sound insulation properties. The independence of the panels also make it possible to consider the wall of each portion of the viable space as a surface located in the reference grid independently of the other walls. This also applies to all the filling members and therefore to the whole structure.

Due to the gap *i* between adjacent horizontal supporting and supported members the single or double walls can have a random vertical extension and can more particularly extend over several levels.

Certain parts of the viable space can be surrounded by a wall formed by a shell, e.g. made from a plastic material defining an internal volume of random geometrical shape. The vertical supporting members or posts 5 are advantageously insulated by a double wall defining an intermediate space in which can be placed an insulating material. This can be realized by means of a tube which is co-axial to the post 5 which is positioned internally or by externally coating the posts with an insulating material layer such as asbestos surrounded by a facing sheet. The technical space utilising the internal volume of the posts is thus completely insulated by a double wall throughout the whole structure.

Now that the preferred embodiments of the invention have been described and illustrated, it must be understood that these are capable of variation and modification and it is not therefore desired to be limited to the precise details set forth, but to include such modifications and alterations as fall within the scope of the appended claims.

I claim:

1. A modular autostable structure for an architectural system, said structure serving to divide the space occupied by said system and comprising:

a horizontal square meshed reference grill formed by two orthogonally directed sheets, each formed of rectilinear strips of width *i* spaced uniformly a distance *p* so that said grid is provided with squares with sides $p-i$ separated from the adjacent squares by a gap of width *i;* hollow cylindrical vertical supporting members each having a vertical axis passing through the center of a square in said grid;

horizontal supporting and supported members in the form of hollow bodies of the same external vertical dimensions and having vertical side walls provided with openings and internal transverse vertical partitions also provided with openings, said horizontal members having external horizontal dimensions which can be expressed as $mp+i$, $kp$ or $np-i$, where $m$, $k$ and $n$ are positive integers, said horizontal members being arranged in a horizontal plane corresponding to one level of said system, in accordance with said reference grid, each of said horizontal supporting members connecting two vertical supporting members, the parallel adjacent horizontal members being separated by a gap of width *i* corresponding to one strip of said reference grid, and the internal space of said horizontal members forming a continuous space communicating with the internal space of at least one of said vertical supporting members, and having a plurality of access points to provide a duct for conveying fluids and current; and connecting means connecting in strictly reversible manner the horizontal supporting members to the vertical supporting members and each horizontal supported member to at least one other horizontal member, said connecting means mechanically connecting resistant portions of said horizontal members, said resistant portions being constituted by said vertical side walls and transverse partitions, to ensure the continuity of said resistant portions in both directions of said reference grid.

2. A structure according to claim 1 wherein said connecting means comprises first connecting devices each connecting a horizontal supporting member to a vertical supporting member and comprising a hollow cylindrical core coaxial with said vertical member and forming a part thereof at said level of the system, and at least one bracket, of the same height as said horizontal members and having a first wall portion connected to said core, a second wall portion connected to said horizontal supporting member and side wall portions connecting said first and second wall portions, said second wall portion extending along a side of the square of the reference grid through which center passes the vertical axis of said vertical member and said core, said first wall portion and said second wall portion being each provided with an opening so that the internal space of said vertical and horizontal supporting members are in communication.

3. A structure according to claim 1 and further comprising auxiliary horizontal supporting elements whose length can be expressed in the form $np+i$ and whose width is less than the width of said horizontal supporting members, said elements having their ends connected to vertical supporting members.

4. A structure according to claim 1 and further comprising auxiliary horizontal supporting elements of the trimmer type whose length can be expressed in the form $np+i$ and whose width is equal to *i*, said trimmers having a position corresponding to a strip of width *i* of said reference grid.

5. A structure according to claim 1 and further comprising horizontal filling members including floor members, ceiling members and sealing plates, and vertical filling members including panels, stopping plates and facing plates, said sealing and stopping plates blocking vertical and horizontal openings of horizontal members of the structure for limiting and compartmentalising the duct in said one horizontal level of the structure.

6. A structure according to claim 5 wherein each duct is surrounded by a continuous wall separated from the other walls of the system of an insulating space.

7. A structure according to claim 6, and further comprising an insulating layer and a sealing layer disposed within the insulating space adjacent to the floor members.

8. A structure according to claim 1 wherein said horizontal members are parallelepipedal hollow bodies of width $np-i$ comprising a longitudinal rigid body, double-walled internal transverse partitions and end partitions, said double-walled partitions comprising two walls separated by a gap of width $i$ and being spaced longitudinally a distance of a multiple of $p$.

9. A structure according to claim 8 wherein said connecting means comprise second connecting devices connecting parallel adjacent horizontal members, each of said second connecting devices comprising at least a shim extending vertically in the gap of width $i$ between the facing vertical side walls of two adjacent parallel horizontal members, said shim being connected to each of said side walls at a location adjacent one vertical lateral end portion of a partition.

10. A structure according to claim 8 and further comprising connected orthogonally directed horizontal members, the connection between two of such members being realized by bolting of the end partition of one member to a side-wall of the other member, said one member having its side walls aligned with internal partition walls of said other member.

11. A structure according to claim 8 and further comprising at least two parallel adjacent horizontal members and horizontal plates secured to the upper and lower faces of each of said members at a level thereof where a tranverse internal partition is provided.

12. A method for producing an architectural system including vertical and horizontal members defining an autostable modular structure by which the volume occupied by said system may be divided, said process comprising:

positioning hollow and cylindrical vertical supporting members each having its vertical axis passing through the center of a square of a horizontal square meshed reference grid formed by two orthogonal sheets, each formed by rectilinear strips of width $i$ spaced uniformally at distance $p$ so that said grid forms squares with sides $p-i$ separated from the adjacent squares by a gap of width $i$;

providing horizontal supporting and supported members having hollow bodies of the same external vertical dimensions and vertical side walls provided with openings and internal transverse vertical partitions also provided with openings, said horizontal members having external horizontal dimensions which can be expressed as $mp+i$, $kp$ or $np-i$ where $m$, $k$ and $n$ are positive integers;

arranging said horizontal members in a horizontal plane corresponding to one level of said system in accordance with said reference grid,. with each of said horizontal supporting members joining two vertical supporting members, with parallel adjacent horizontal members being separated by a gap of width $i$ corresponding to one strip of said reference grid and with the internal spaces of said horizontal supporting and supported members forming a continuous space communicating with the internal space of at least one of said vertical supporting members, and having a plurality of access points to provide a duct for conveying fluids and current; and securing together said vertical and horizontal members in strictly reversible manner, said horizontal members being connected together by mechanically connecting the resistant portions of said horizontal members, said resistant portions being constituted by said vertical side walls and partitions, to ensure the continuity of said resistant portions in both directions of said reference grid, whereby a modular, autostable structure for a architectural system is obtained.

13. A method according to claim 12 and further comprising positioning of modular and interchangeable filling members to divide space occupied by said system, said filling members being supported by said horizontal members positioned in accordance with said reference grid, at least some of said filling members constituting double-walled vertical partitions having strips of width $i$ of said reference grid.

* * * * *